US005871163A

United States Patent [19]

Bertoli et al.

[11] Patent Number: 5,871,163

[45] Date of Patent: Feb. 16, 1999

[54] METHOD AND DEVICE FOR THE CONTINUOUS AUTOMATIC MONITORING AND CONTROL OF THE TENSION TO WHICH YARN IS SUBJECTED DURING ITS WINDING

[75] Inventors: Luciano Bertoli, Fiume Veneto; Roberto Badiali, Pordenone; Giorgio Colomberotto, Sacile, all of Italy

[73] Assignee: Savio Macchine Tessili, S.p.A., Pordenone, Italy

[21] Appl. No.: 936,291

[22] Filed: Aug. 25, 1997

Related U.S. Application Data

[63] Continuation of Ser. No. 614,022, Mar. 12, 1996, abandoned.

[30] Foreign Application Priority Data

Mar. 31, 1995 [IT] Italy ..... MI95A0648

[51] Int. Cl.[6] ..... B65H 59/22; B65H 59/10; B65H 63/00

[52] U.S. Cl. ..... 242/150; 242/419.3; 242/36

[58] Field of Search ..... 242/147 M, 150 M, 242/419.3, 422.2, 36, 18 R

[56] References Cited

U.S. PATENT DOCUMENTS

| | | | |
|---|---|---|---|
| 3,100,091 | 8/1963 | Mindheim et al. | 242/150 M |
| 4,805,846 | 2/1989 | Ueda et al. | 242/18 R |
| 4,880,175 | 11/1989 | Yamauchi et al. | 242/150 M |
| 5,046,673 | 9/1991 | Moussalli | 242/150 M |
| 5,238,202 | 8/1993 | Sheehan et al. | 242/150 M |
| 5,377,923 | 1/1995 | Matsui et al. | 242/18 R |
| 5,445,334 | 8/1995 | Matsui et al. | 242/18 R |
| 5,499,772 | 3/1996 | Maeda et al. | 242/18 R |

FOREIGN PATENT DOCUMENTS

| | | |
|---|---|---|
| 0319477 | 7/1989 | European Pat. Off. . |
| 0691298 | 10/1996 | European Pat. Off. . |
| 3528937 | 2/1987 | Germany . |
| 3812449 | 11/1988 | Germany . |
| 3904065 | 8/1989 | Germany . |
| 452452 | 5/1968 | Switzerland . |
| 93210096 | 10/1993 | WIPO . |

*Primary Examiner*—Michael Mansen
*Attorney, Agent, or Firm*—Kramer Levin Natfalis & Frankel; George P. Hoare, Jr.

[57] ABSTRACT

A method and device for the continuous automatic monitoring and control of the tension to which yarn is subjected in a winding unit, in particular in an automatic bobbin winding unit, in which along the travel path the clamping force of the braking washers on the yarn is continuously and automatically controlled on the basis of parameters defining the type of yarn being wound and the operational, technical and geometrical characteristics of the feed package being unwound and those of the overlying bobbin under formation.

6 Claims, 4 Drawing Sheets

METHOD AND DEVICE FOR THE CONTINUOUS AUTOMATIC MONITORING AND CONTROL OF THE TENSION TO WHICH YARN IS SUBJECTED DURING ITS WINDING

This application is a continuation of application Ser. No. 08/614,022, filed Mar. 12, 1996 now abandoned.

BACKGROUND OF THE INVENTION

1. Field of the Invention

This invention relates to a method and device for the continuous automatic monitoring and control of the tension to which yarn is subjected during its winding in a textile machine, in particular in an automatic bobbin winding unit.

2. Description of the Related Art

It is known that in the textile industry each package of yarn spun in a ring spinning machine is fed in the next production stage to an automatic bobbin winding unit, where it is rewound to form a bobbin of substantially cylindrical or frusto-conical shape. The yarn is firstly extracted from the underlying package by pulling, to then pass through a tensioning device to subject the yarn to a constant tension necessary for correct winding onto the bobbin under formation.

In a bobbin winding unit with a grooved drive roller, the tendency to increase winding speed to advantageously achieve increased production results in a considerable increase in yarn tensioning, to the extent that the yarn can undergo breakage. Moreover in practice, as is well known to the expert of the art, when a yarn tension level has been set its average value does not remain constant. It is well known that during the to-and-fro travel of the yarn as it distributes itself along the surface of the bobbin under formation, small short-lasting oscillations in the yarn tension can occur, but generally these are innocuous because they settle about an average value, it being necessary only to control the yarn tension at a preset constant average value. The reasons why the average tension does not remain constant include the increase in the diameter of the wound yarn on the bobbin under formation, the unwinding of the last part of the yarn wound on the feed package, and the presence of dust and trash on the slide guides at the various support points along the path of the yarn being transferred from the underlying package to the overlying bobbin. In addition the average tension is influenced by the type and nature of the yarn being wound and the temperature of the surrounding atmosphere, so that the yarn has to be tensioned taking account of the aforesaid operating parameters in order to establish tension values such that the yarn is always in an elastically taut condition. Otherwise, each time the yarn breaks by separation due to excessive tensioning, the winding operation has to be interrupted to effect a yarn joining process, the winding efficiency of the bobbin winding unit hence undergoing a considerable decrease. At the same time a poor quality bobbin is formed because of the presence of frequent knots, which give rise to difficulties in further operations involving the bobbin. Yarn braking washers are known which operate with brake shoes to generate, by means of a structure of known construction, a preliminary set tension in the travelling yarn. These known devices have various drawbacks. The yarn-braking washers acting on the yarn exert on them a braking force which cannot be exactly defined, and a change in the yarn tension cannot be easily achieved because of the aforesaid reasons. Moreover the known devices require constant and periodic maintenance.

SUMMARY OF THE INVENTION

The present invention eliminates these drawbacks by providing a method for monitoring and controlling the tension to which the yarn in an automatic bobbin winding unit is subjected along its travel path in which the clamping force exerted by the braking washers on the yarn is continuously and automatically controlled at a value depending on predetermined quantities defining both the type of yarn being wound and the operational, technical and geometrical characteristics of the unwinding of the package and those of the bobbin under formation.

In the method of the invention the type of yarn being wound is defined by values indicating its irregularities, its average diameter and the nature of its constituent fibres. In addition, according to the method the operational, technical and geometrical characteristics of the unwinding of the package are defined by the velocity of extraction of the yarn from the feed package and the dimensions and shape of the package itself.

The operational, technical and geometrical characteristics of the bobbin under formation are defined by the yarn tension measured by a sensor along the travel path, the quantity of yarn wound on the bobbin, and the bobbin dimensions and shape.

To implement the described method the invention provides a yarn tensioning device of linear electromagnetic operation, comprising:

- an energization winding in the form of a rectilinear hollow solenoid;
- a piston in the form of a cylinder of magnetic material on which there acts a thrust proportional to the current flowing through the solenoid;
- a shaft transmitting the thrust to the braking washers, which impress a clamping action on the yarn travelling from the feed package to the bobbin being wound;
- electronic means which continuously regulate the intensity of the energization current through the winding in order to vary and set the clamping force on the yarn to a value predetermined on the basis of the type of yarn being wound and of the operational, technical and geometrical characteristics of the unwinding of the feed package and those of the bobbin under formation;
- a disc for damping the oscillations caused by the irregularities of the yarn undergoing the winding process. With the device, by reversing the current fed to the rectilinear hollow solenoid, the magnetic piston is made to move such as to withdraw the braking washers from each other to the extent of enabling the yarn to be inserted between and extracted from the washers, and to enable the fluff and dust accumulated between the washers to be removed.

BRIEF DESCRIPTION OF THE DRAWINGS

A preferred embodiment of the invention is described hereinafter by way of non-limiting example with reference to the accompanying drawings.

In the accompanying drawings.

DESCRIPTION OF THE PREFERRED EMBODIMENTS

Figure 1:
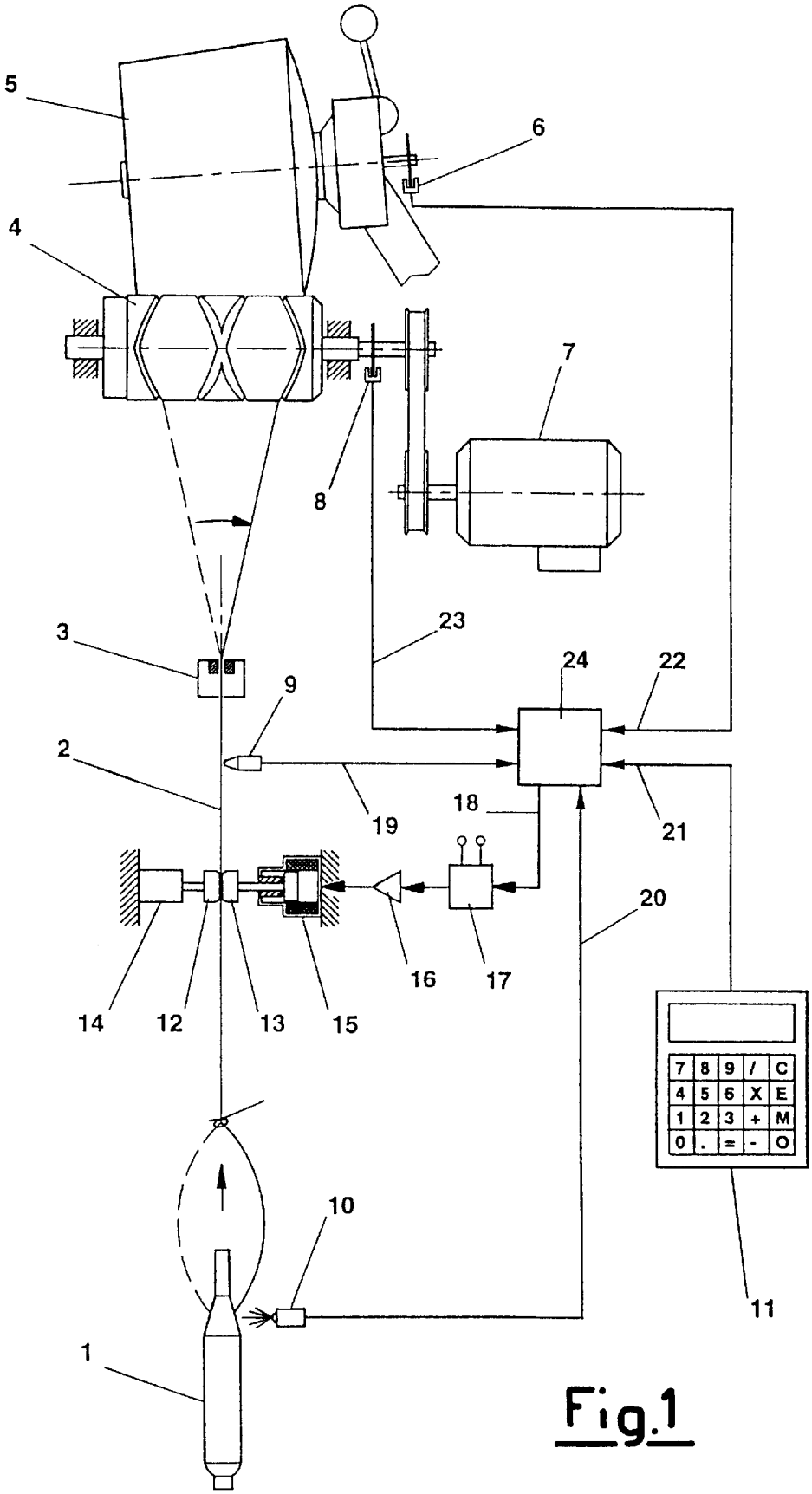
FIG. 1 is an overall schematic view of the device of the present invention incorporated into an individual bobbin winding station, said view showing an example of a general structure in which the sensors, the monitoring probes, the drive source for the grooved roller, the known devices along the path of the yarn unwinding from the underlying package and the keyboard are all in operation and are connected to the control unit.

In the figures, equal elements or elements of equal or equivalent function carry the same reference characters for simplicity. Those devices and mechanisms operating in mutual cooperation with the device of the present invention are not shown, neither is their operation described, in that these are already known and do not concern the operation of the invention.

In an automatic bobbin winding unit shown schematically in FIG. 1, the yarn 2 extracted from a package 1 is drawn upwards by known devices to be joined in perfect continuity to the end of the yarn wound on the bobbin 5, to commence the known rewinding of the yarn 2, ie the transfer of the yarn 2 from the underlying package 1 to the overlying bobbin 5. As it unwinds from the package 1, the yarn 2 drawn upwards by the drive roller 4 results in a gradual and continuous reduction in the wound yarn until the yarn 2 has been completely unwound from the reed package 1. The state of the unwinding is monitored by the photoelectric cell 10, which generates an electrical position signal which is fed through the cable 20 to the control unit 24.

The yarn 2 leaving the package 1 travels rapidly upwards through a series of devices, including the yarn tensioning washers 12 and 13 of the device of the present invention, a tension sensor 9 and the electronic yarn clearer 3, which acts as a device for automatically monitoring yarn presence and actively controlling the cleaning function of an electronic yarn cleaner in the individual bobbin winding station of FIG. 1.

The electronic clearer 3 can be of conventional construction and can contain an electrical or capacitive sensor-transducer as the yarn feeling or exploration device. The yarn 2 is wound onto the bobbin 5 under formation by the drive source 7, preferably a three-phase electric motor, which via a variable frequency inverter rotates the drive roller 4 to provide the to-and-fro transverse movement to the yarn 2 unwound from the underlying package 1, and to rotate the bobbin 5 under formation. During the unwinding the disc probes 8 and 6 sense the rotation of the drive roller 4 and bobbin 5 to generate electrical pulses which are fed to the control unit 24 via cables 23 and 22. The control unit 24 uses said rotation pulses to exactly control the rotational speed of the roller 4 during its various predetermined operating stages and to measure the quantity of yarn 2 wound on the bobbin 5 under formation. The tension sensor 9 which moment by moment measures the tension of the yarn travelling between the package and the bobbin continuously transmits said value, in the form of an electrical signal, to the control unit 24 via the electric cable 19.

Said electrical signals entering the control unit 24 are amplified and compared with reference values fed into said unit 24 via the keyboard 11 and the connection cable 21.

The control unit 24 is based on a miniprocessor able to memorize the operator's instructions and transform said instructions into a program for execution by its computing and processing centre to provide the numerical and graphical results required during the entire winding process. Said numerical and graphical results are then stored in the memory of said control unit 24, which specifically controls the yarn tensioning device of the present invention. Each time the electrical signals originating from the tension sensor 9 and entering the control unit 24 differ from the reference values of the range of allowable values, the control unit 24 generates output electrical signals which via the electric cable 18 actuate and control the clamping force of the braking washers 12 and 13 on the yarn 2, provided by the electromagnet 15.

The range of allowable tension values of the travelling yarn is established by a processing operation by the miniprocessor of the unit 24, which uses both the operator's instructions fed in via the keyboard 11 regarding the type of yarn being wound, and the values of the electrical pulses generated by the sensor 10 and by the disc probes 6 and 8. The said input electrical pulses continuously provide the operational, technical and geometrical characteristics of the unwinding of the package 1 and those of the bobbin 5 under formation.

Figure 4:
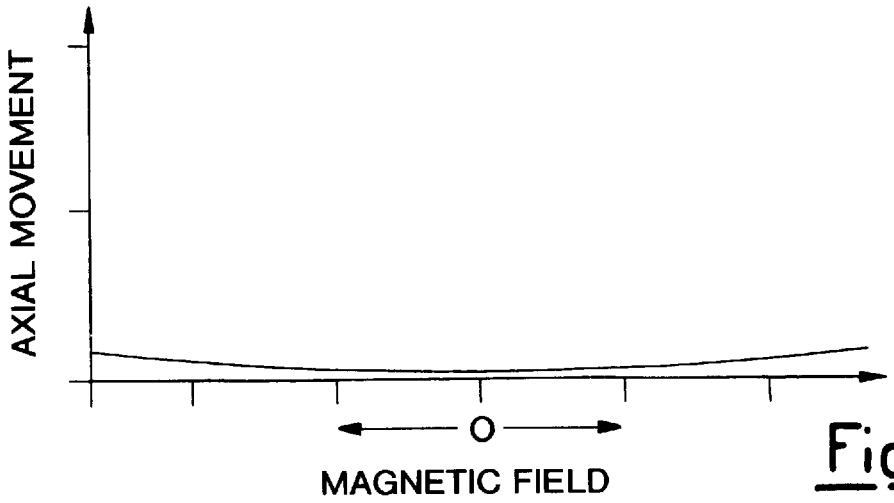
FIG. 4 is a graph showing the axial movement of the magnetic cylinder within the rectilinear hollow solenoid as a function of the magnetic field within the solenoid.
Figure 5:
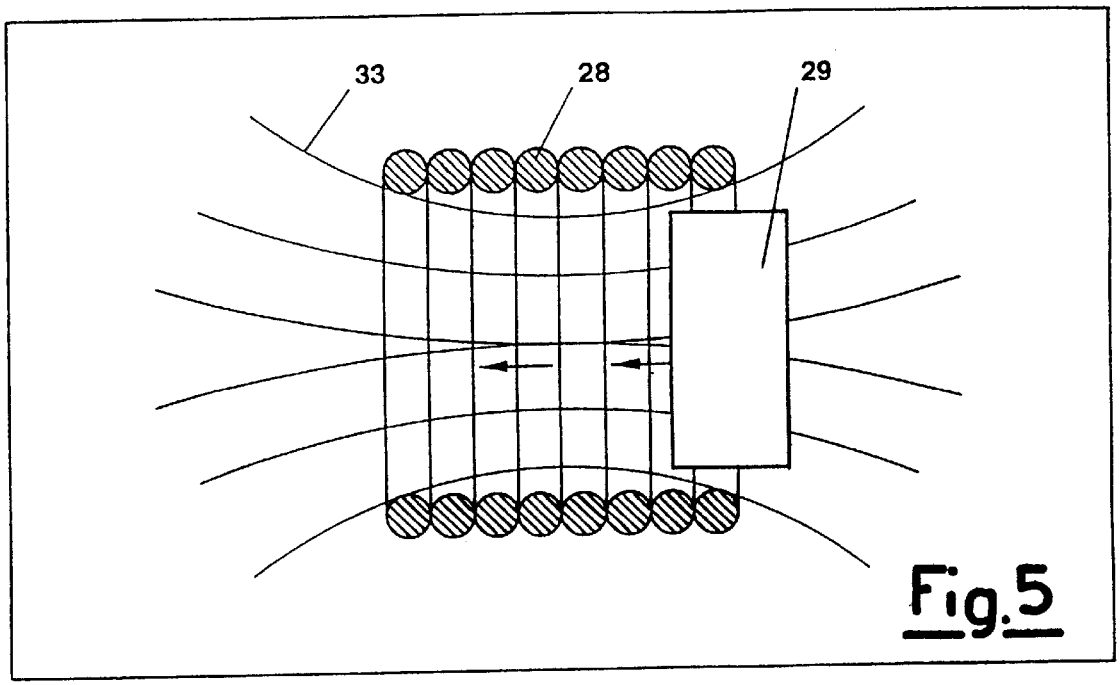
FIG. 5 is a schematic enlarged view showing the lines of magnetic force involved in the linkage between the magnetic cylinder and the rectilinear solenoid.

The said electrical signals leaving the control unit 24 via the cable 18 activate and control an electrical power unit 17 which generates an electric current flow, advantageously stabilized and smoothed by the amplifier 16, passing through the energization winding 28 acting on the magnetic cylinder 29, which generates a thrust proportional to the current through the solenoid 28. The thrust is transmitted via the shaft 30 to the movable washer 13, which advances axially to impress a clamping action on the travelling yarn 2. The clamping action is controlled and set continuously by the current intensity through the winding 28, which when traversed by current generates a magnetic field 33 substantially linear at its ends (see FIGS. 4 and 5 ) because of its rectilinear configuration.

The magnetic cylinder 29, which during clamping is positioned at one end of the rectilinear hollow solenoid 28, is subjected to a virtually constant force. In the application claimed herein, the force acting on the magnetic cylinder 29 will therefore be constant about the end of the rectilinear solenoid.

Figure 2:
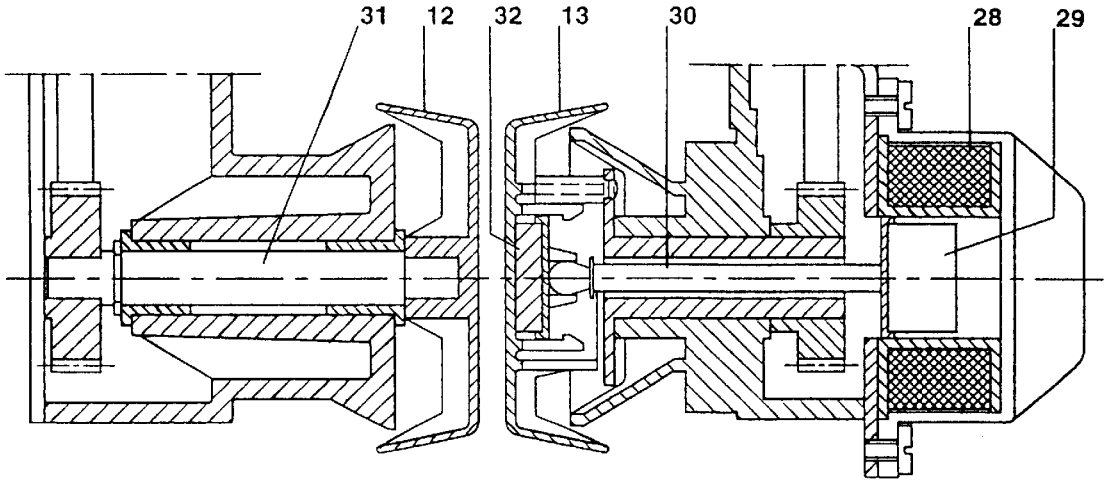
FIG. 2 is a partly sectional schematic front view of the tensioning device of the present invention at the moment in which the braking washers are sufficiently spaced apart to allow the yarn to be inserted or extracted or to allow the washers to be cleaned.
Figure 3:
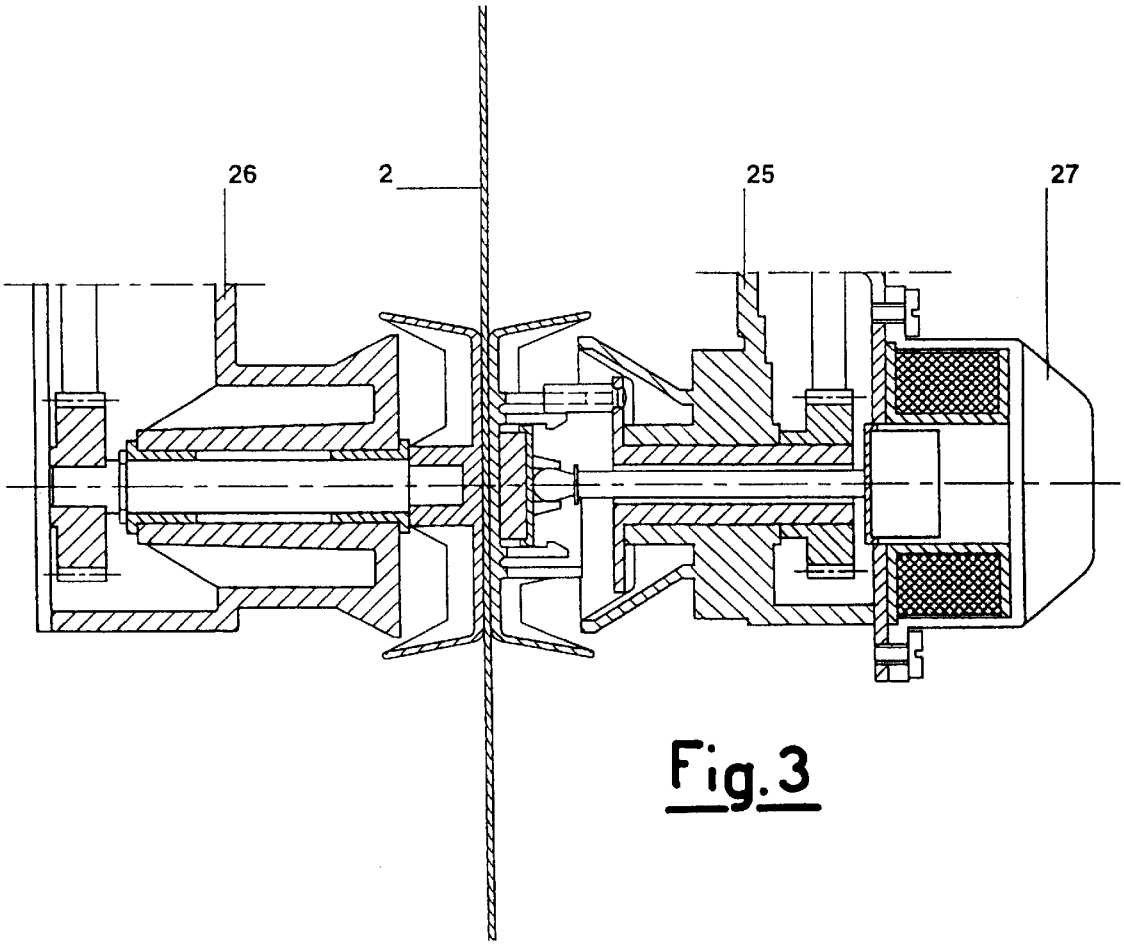
FIG. 3 is a partly sectional schematic front view of the tensioning device of the present invention at the moment in which the moving yarn present between the braking washers is advantageously subjected to a clamping force.

As the magnetic field produced within the solenoid is proportional to the traversing current, the force on the magnetic cylinder is also proportional to the current. The direction of the force on the cylinder 29 depends on the direction of the magnetic force within the solenoid 28, which is protected by the cover 27. An opposite force can hence be achieved on the magnetic cylinder 29 such as to generate a movement which withdraws the braking washers 12 and 13 from each other sufficiently to facilitate the insertion or extraction of the yarn 2 between or from the washers (see FIG. 2).

The washer 12 is advantageously rigidly mounted on the shaft 31 and the entire yarn tensioning device is rigidly connected to the structure of the winding station by support elements 25 and 26. While the magnetic cylinder 29 is within the end region of the solenoid the yarn tensioning device of the invention is not influenced by variations in the diameter of the yarn 2 being wound, the presence of the damping disc advantageously contributing to nullifying any oscillation caused by more or less accentuated irregularities in the yarn undergoing the bobbin winding process.

We claim:

1. A device for monitoring and controlling tension of yarn wound in a path from a feed package to a bobbin in a bobbin winding unit, comprising:

(a) opposable braking washers in the yarn path having a distance therebetween for providing tension to the yarn;

(b) a shaft having a first end and a second end, wherein said first end is connected to one of said washers;

(c) a magnetic cylinder connected to said second end of said shaft;

(d) a hollow solenoid having an electrical winding at least partially surrounding said magnetic cylinder for generating a magnetic field, wherein said magnetic cylinder is positioned at one end of said electrical winding, and wherein said magnetic field is substantially linear and its force acting on said magnetic cylinder is substantially constant regardless of yarn irregularities; and (e) electrical means having an output connected to said electrical winding for regulating the current thereto in accordance with predetermined criteria for adjusting the amount of tension applied to the yarn independent of the distance between said opposable braking washers.

2. The device of claim 1, wherein the current applied to said output is reversed so that said washers can move apart.

3. The device of claim 1, wherein said magnetic winding is axially longer than said magnetic cylinder.

4. A method for monitoring and controlling tension of yarn wound in a path from a feed package to a bobbin in a bobbin winding unit having opposable braking washers having a distance therebetween in the yarn path for providing tension to the yarn, a shaft having a first end and a second end, wherein said first end is connected to one of said washers, a magnetic cylinder connected to said second end of said shaft, a hollow solenoid having an electrical winding at least partially surrounding said magnetic cylinder for generating a magnetic field, wherein the magnetic cylinder is positioned at one end of the electrical winding, and wherein the magnetic field is substantially linear and its force acting on the magnetic cylinder is substantially constant regardless of yarn irregularities, a sensor in the yarn path for determining yarn tension, and electrical means having an input connected to said sensor and an output connected to said electrical winding, comprising:

(a) comparing said input to predetermined criteria;

(b) adjusting said output in accordance with said predetermined criteria to achieve desired yarn tension independent of the distance between said opposable braking washers.

5. The method of claim 4, wherein said predetermined criteria include the velocity of the yarn travelling in the path from the feed package to the bobbin, the amount of yarn on the feed package, and the shape of the feed package.

6. The method of claim 4, wherein said predetermined criteria include the type of yarn, the average diametrical dimensions of the yarn irregularities, and the nature of the yarns irregularities.

* * * * *